US006623268B2

(12) United States Patent
Diamond et al.

(10) Patent No.: US 6,623,268 B2
(45) Date of Patent: Sep. 23, 2003

(54) BUTANE COOKING GAS CONTAINER

(76) Inventors: George B. Diamond, 62 Anthony Rd., Glen Gardner, NJ (US) 08826; Ralph H. Helmrich, 62 Anthony Rd., Glen Gardner, NJ (US) 08826; Kihong Kim, 48 Cedar Dr., Tuxedo, NY (US) 10987; Chung Han Kim, 1800 Rachel Ter. #18, Pine Brook, NJ (US) 07058

( * ) Notice: Subject to any disclaimer, the term of this patent is extended or adjusted under 35 U.S.C. 154(b) by 0 days.

(21) Appl. No.: 09/942,151

(22) Filed: Aug. 29, 2001

(65) Prior Publication Data

US 2002/0074363 A1 Jun. 20, 2002

Related U.S. Application Data

(60) Provisional application No. 60/229,664, filed on Aug. 31, 2000.

(51) Int. Cl.[7] ..... F23D 11/00; F23D 14/28

(52) U.S. Cl. ..... 431/344; 431/206; 126/39 R; 222/113

(58) Field of Search ..... 431/344, 206, 431/11; 126/39 R; 222/113

(56) References Cited

U.S. PATENT DOCUMENTS 3,140,740 A * 7/1964 Lagreid et al. ..... 126/6
4,087,022 A 5/1978 Zanetti-Streccia
4,899,722 A 2/1990 Horewitch
5,080,580 A * 1/1992 Clapp ..... 431/232
5,098,283 A * 3/1992 Clapp ..... 431/11
5,211,317 A 5/1993 Diamoond et al.
5,271,533 A 12/1993 Joulia
5,890,887 A 4/1999 Adler
6,189,557 B1 * 2/2001 Chern ..... 137/212

OTHER PUBLICATIONS

International Search Report mailed Dec. 27, 2001, for Intl. Application No. PCT/US01/27123.

* cited by examiner

*Primary Examiner*—Alfred Basichas
(74) *Attorney, Agent, or Firm*—Ostrolenk, Faber, Gerb & Soffen, LLP

(57) ABSTRACT

A butane fuel supply container for a cooking stove, the container has a thin side wall held rigid by the vapor pressure of the fuel, but the side wall can be finger deformed when the can has been depressurized or hand crushed with the exit valve of the container open, the vapor therein being expelled as the container is deformed or crushed. The vapor tube has a vapor entrance in the vapor pocket above the pool of liquid fuel when the container is correctly oriented in the stove. The vapor tube passes vapor through a valve at the dome of the container.

17 Claims, 2 Drawing Sheets

BUTANE COOKING GAS CONTAINER

CROSS REFERENCE TO RELATED APPLICATION

This application is based upon and claims priority from U.S. provisional application No. 60/229,664 entitled "BUTANE CAN", filed Aug. 31, 2000.

BACKGROUND OF THE INVENTION

The present invention relates to a sealed, pressurized container for cooking gas for a stove, and more particularly, but without limitation to, a container for dispensing butane, or other flammable liquefied gasses including blends of the common hydrocarbon fuel gasses, to a cook stove. Although the present invention is described in connection with a container for containing and dispensing butane, it is applicable to other liquefied flammable gaseous fuels that may be used in a cook stove, or the like, for fueling a flame, primarily a cooking flame, but the invention is not limited to liquefied gaseous fuel for a stove.

A butane dispensing container or can contains liquid butane that is under pressure to maintain its liquid phase. The quantity of liquid does not completely fill the container so that the container has a vapor pocket above the liquid which, of course, enlarges as the fuel is dispersed. The fuel is provided to a stove as gas received from the vapor pocket. A vapor outlet tube extends from the vapor pocket, typically through the lid of the container, past a dispensing valve and to a burner where it is ignited.

A typical butane supply can is oriented horizontally in use in a stove, with its lid at one end. A vapor outlet tube passes through the lid, and one end of the tube extends into the container. An entrance into the one end of the tube is oriented toward the upper side of the horizontal container, since the vapor pocket will form at the top of the horizontal container. The vapor outlet tube passes through a channel through the lid. The outlet is controlled by a valve that is normally closed and that is openable to permit exit of vapor through the outlet tube and the channel to a fuel burner nozzle.

A conventional locating collar on the container at the lid or on the valve cooperates with a fixture, which is located on a stove where the container is installed, to cause an orientation of the container wherein its vapor outlet tube entrance is vertically up extending into the vapor pocket. The pressurized vapor is forced out through the outlet tube and the channel past the valve to the burner. If the butane fuel container is intended to be installed at an orientation other than horizontal, the placement of the entrance of the vapor outlet tube in the container is accordingly adjusted to be in the vapor pocket above the surface of the liquid pool.

Currently used, non-refillable, butane cans or containers are conventionally of three piece construction (or specialized, heavy wall, one or two piece construction). Conentional three piece cans include a can side wall with a welded vertical side seam, a separate seamed on or welded bottom and a separate seamed on or welded lid. Any of these three seamed areas or welds may leak or burst. The burst strength of a can is controlled by the tensile strength of the material used, its thickness, the can diameter and height and the weakness of any seams or welds. Reducing the number of seams obviously reduces the danger of leakage or bursts. Since there are conventional can diameters and can heights for fuel containers used in cookers, the containers must be sized to standard specifications.

Control over can wall thickness is important. Obviously, the wall must be thick enough not to burst under the pressures that may develop in the can, e.g. from severe heating, possibly caused by storage in summer heat. Consequently, the material of the can wall, its tensile strength and the thickness of the can wall are coordinated with the standard diameter for the can and with the pressure which is expected to develop in the can upon pressurizing the butane fuel to a particular level and upon the normal range of temperatures to which such cans may be exposed.

A major cost of a filled butane fuel can or container is the cost of the metal can itself, including the cost of materials and the cost of manufacture. Use of less material through thinner can walls and reducing the number of seams to be formed or welded should make can manufacture less expensive.

Further, all cans or containers from which butane fuel is exhausted should be disposable. There is an explosion danger with pressurized fuel. The cap of the container or can has a release valve for releasing any pressure remaining in the can before disposal of the can. The pressure may also be released in any other known manner for pressurized cans. Of course, a recycler receiving a standard rigid wall butane container would not be able to know if the can had been depressurized before it was given to the recycler. For safety, the recycler may have to depressurize the can to be sure it would not explode, at considerable labor cost.

A conventional, non-refillable, cylindrical shape, butane fuel container has a thick side wall, perhaps 0.009–0.010 inch steel, and the container is assembled from three parts. After the contents of the container have been fully exhausted, for practical purposes, the can still retains butane vapor. In the case of the most common size of butane cooking gas container, there would be approximately 520 millileters of butane gas at or slightly above atmospheric pressure remaining in the can. The standard can wall remains so rigid when the can is emptied that the can cannot be easily crushed by normal adult hand pressure or even be deformed by normal adult finger pressure. It is therefore dangerous and may be difficult to recycle the can, except in an explosion proof recycling apparatus or after individual attention to the can to surely depressurize it. As noted, the typical can has a means to manually release the residual pressure, so that the user of the can may exhaust its contents to reduce any explosive hazard. But the recycler receiving such a can would not know and could not determine during simple handling of the can if the can pressure had been reduced to a level where the explosion danger had been virtually eliminated.

SUMMARY OF THE INVENTION

It is a primary object of the invention to provide a container or can for a pressurized burner fuel, which is light in weight, inexpensive for materials and manufacture, as compared with conventional fuel supply containers or cans, is disposable with clear indication that it is safe for disposal, is crushable after use, if the user wishes, and which may improve the efficiency of the burner supplied by the fuel.

According to the invention, the fuel supply container or can, particularly the butane can, is a two piece can formed in a cold forming drawing and ironing process. The drawing and ironing process provides a bottom and a side to the can, so that no welds or seams are present from the bottom to the can or along the side of the can. A top or lid having a dome shape is seamed or welded on the open end of the can. The process may be also performed in reverse by forming the lid integrally with the side walls and then attaching a bottom. The container is preferably formed of steel. The forming process increases metal strength so it permits a thinner can wall. A one-piece container can also be made by first forming the bottom and sides by the drawing and ironing process and then necking in the upper portion of the side walls to form a top or the lid for the container with an opening for the valve.

The side wall of the butane container of the invention is thinner than side walls of conventional butane containers. The can side wall is of such material and is thin enough for the can diameter and height that the can side wall can be deformed with ease, when the can is depressurized by normal finger pressure of a typical adult of 5 pounds force and the can can be crushed by normal hand pressure of that typical adult of 20 pounds force when the pressure release valve of the can is held open and such finger or hand pressure is applied to the can by the typical adult. In other words, the can is soft or deformable to the touch when depressurized, but is rigid to the touch while it still retains pressure. This gives anyone, consumer or recycler, who touches the can, an immediate tactile indication of whether or not the can has been depressurized and is safe for disposal.

For a recycler, the benefit of knowing that a can is safe for disposal, without having to test it or depressurize it to be certain, provides a saving in effort. The "finger pressure" deformation test, the simple tactile sensation of deformability by a person's fingers holding the can, even without the person having to actually deform the can, provides a simple test of whether a can is depressurized. It is an important, yet simply performed safety test, particularly before recycling the can.

For example, the wall of a steel can according to the invention might be 0.002–0.006 inch and preferably 0.005 inch thick, rather than the conventional steel wall for such a can, which is 0.009–010 inch. Correspondingly, an aluminum can wall would have a thickness selected dependent upon the alloy material selected for the can wall, the pressure in the can and the can diameter, since a smaller diameter can would provide a stronger wall for a particular wall thickness than a larger diameter can.

There are additional benefits to this can design. As vapor is expelled through the can outlet to the burner, there is a drop in temperature of the liquid and a corresponding drop in pressure of the vapor at the valve and at the final outlet from the can due to the vaporization of the liquid butane, and the resultant flame fueled by the vapor becomes somewhat smaller and may cook less effectively. A thinner side wall of the can is a better heat conductor than is a thicker wall. The heat of the burner may heat the vapor tube leading from the container and may heat the container as well. The ambient heat of the environment will also heat the container. The heat from both of these sources is conducted into the butane container better by a thinner side wall than by a thicker wall, thus keeping the butane contents at a slightly higher temperature and improving the resultant flame produced at the burner. If the side wall of the can is a better heat conductor, there is less of a pressure drop in the can due to the cooling from vaporization, so better vaporization and more vapor pressure is generated.

In contrast to a rigid container, for which a recycler would not be able to determine, from looking at the can, whether it had been depressurized, when the thin walled can of the present invention is crushed after opening at the valve and exhausting its contents, this would provide a clear indication that the can has been depressurized and that it may be safely disposed of or recycled. In the event that the can has been depressurized but not crushed, the consumer or recycler can easily determine by simply squeezing the can whether or not it has been depressurized. If it is soft to the touch, it has been depressurized and is safe to recycle. If it is rigid, it has not been depressurized and presents a hazard if recycled.

Other objects and features of the invention will become apparent from the following description of a preferred embodiment considered in conjunction with the accompanying drawings.

DESCRIPTION OF A PREFERRED EMBODIMENT

Figure 1:
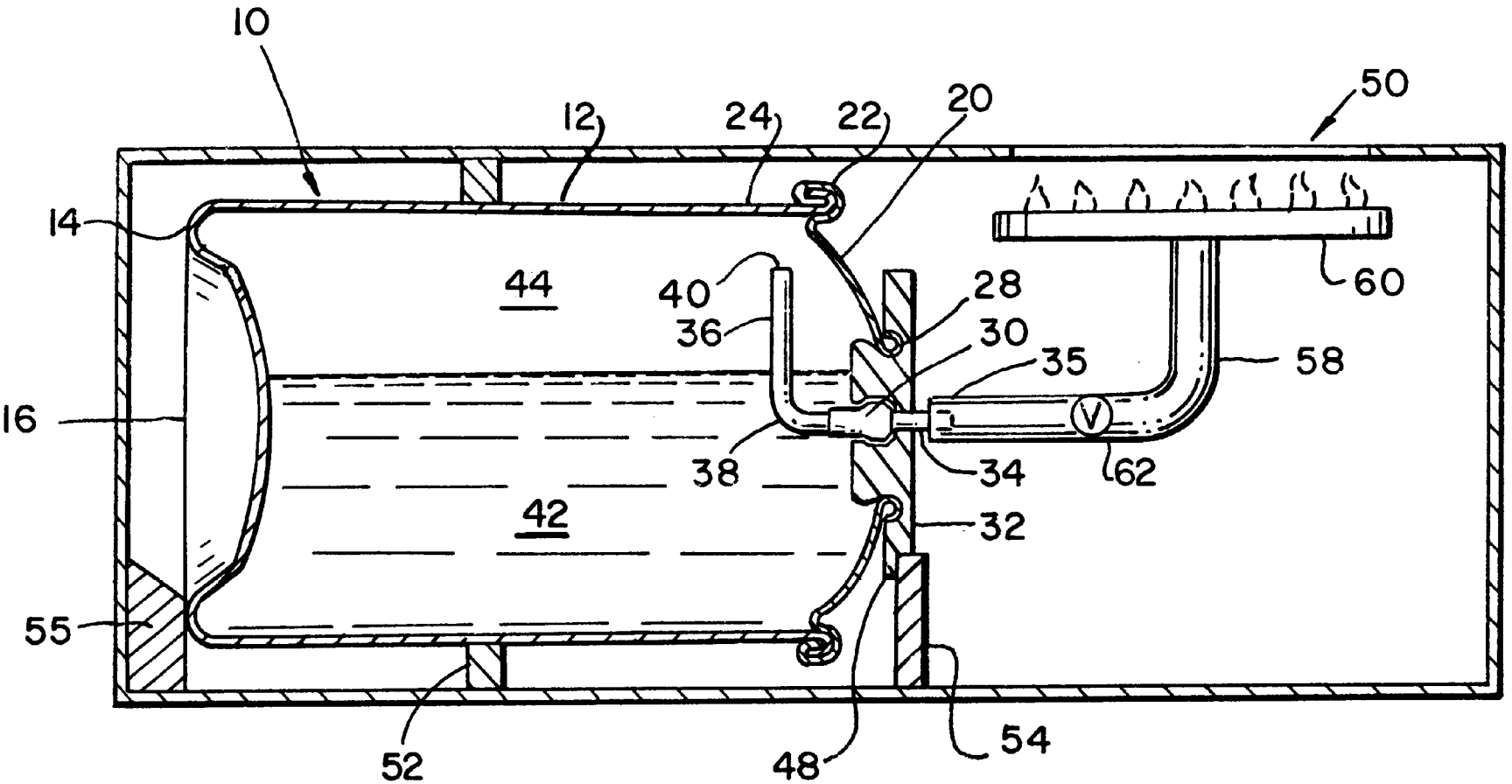
FIG. 1 is a side cross-sectional view of a butane fuel supply container according to the invention and also shown installed in a cooking stove.

The fuel container or can for use for containing and dispensing butane is a metal can, that is conventionally drawn and ironed, e.g. in a process typically used for two piece cans such as beverage cans. After fabrication of the can, it has a cylindrical side wall 12. It has a shaped bottom end 14 with a concave central region 16 which is shaped to provide strength. A dome shaped lid 20 is seamed or welded, at the periphery of the lid 20 and the top edge of the can wall 12, to define the welded or seamed seal 22, which is the only seal of this can. The region of the can wall which is crimped and welded at the seam 22 is a flange portion 24 which starts from just below the top edge of the lid up to the top edge of the lid. In a drawn and ironed can and for improving burst strength and permitting the seaming, the end wall 14, 16 is thicker than the flange 24 which, in turn, is thicker than the side wall 12 of the can.

Figure 2:
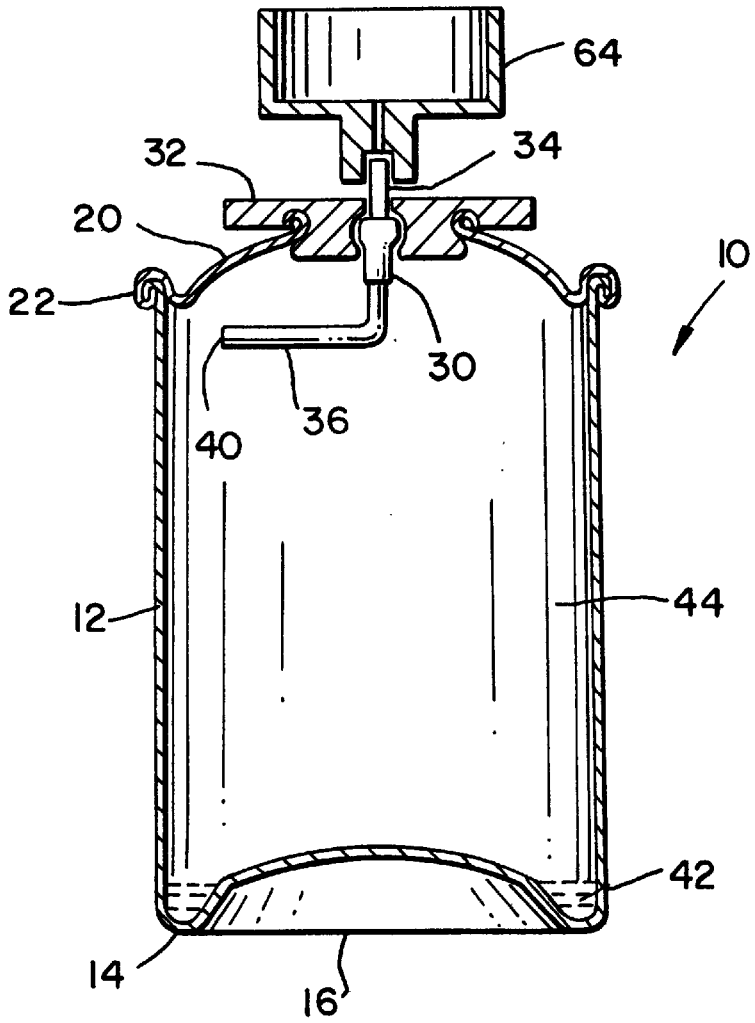
FIG. 2 is a side cross-sectional view of the container ready for depressurizing.
Figure 3:
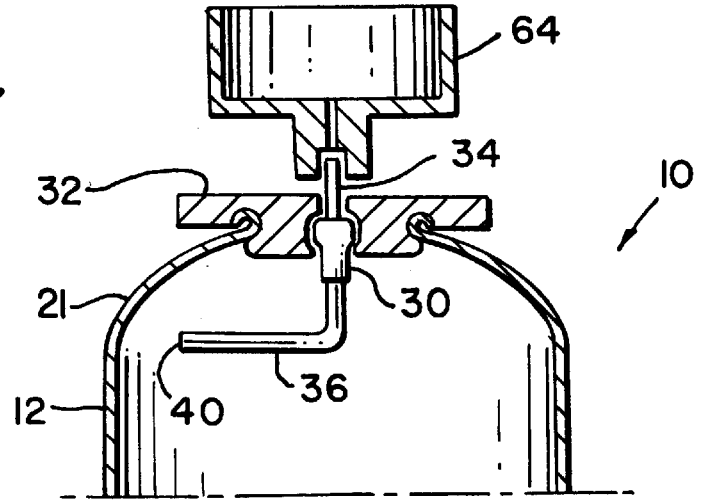
FIG. 3 is a fragment of a container, showing a modified design from that in FIG. 2.

FIGS. 1 and 2 show a two part can, with a body and an attached lid. Alternatively, the bottom of the can could be a separate piece, while the lid is formed integrally with the can body. FIG. 3 shows a one piece can wherein the entire body including the side wall 12 and the lid 21 are integrally formed as one piece without any seam, like that at 22 in FIG. 2.

The can may be of steel or of aluminum, as a particular can designer selects, or even of another metal material. For a typical steel can that might be used, the bottom end of the can might have a thickness of about 0.015 inch, the flange of the can might have a thickness of about 0.007 inch, and the side wall might have a thickness of about 0.005 inch. The can may be alternatively made of aluminum, of a suitable thickness of an aluminum alloy that will perform as described herein. The foregoing values are selected for a can which when filled would have a pressure of 15 to 70 psig at normal ambient temperature of 70° F. or 21° C. The lid 20 may be of the same metal as the remainder of the can, but may be somewhat thicker, since it must maintain its shape at the various operating and depressurizing conditions.

The lid 20 has a central opening at 28. A valve 30 for release of the butane gas, with a valve cup 32 around it, is disposed in the opening 28. The valve cup and the lid are crimped together at the periphery of the opening 28 in a conventional manner. The valve 30 is one that is typically spring biased in the closed position, and it includes a valve stem 34 which opens the valve when it is connected to and depressed by a valve receiving fitting 34 in the channel 58 leading from the valve 30 to a burner 60.

The container is typically oriented in a butane stove with the main axis of the container horizontal so that its lid is to one side. Outlet from the interior of the container 10 and inlet to the valve 30 is through a vapor outlet tube 36 which has an elbow 38 so that the vapor entrance 40 to the tube will be up toward the top of the container 10 when the container is installed horizontally in a stove. The container is filled with a liquid butane supply 42 to a maximum height that is below the entrance 40 to the outlet tube. The volatile liquid fuel creates a pressurized vapor pocket 44 above the pool of liquid, and the butane fuel in vapor form and under pressure exits the container 10 through the inlet 40 leading to the valve 30.

The cook stove 50 where the container 10 is installed in use has a support shelf 52 for positioning the container and a fixture 54 for cooperating with the location and orientation collar 48 on the valve cup 32 for orienting the container so that the vapor outlet tube 36 through which the vapor exits has its entrance 40 oriented upwardly in the vapor pocket. The valve 30 is connected with a channel 58 which leads to the burner 60 which has outlets where the cooking flame is formed. A locating collar 48 around the valve cup 32 is coordinated with a locating fixture 54 in the typical cook stove in which the container 10 is installed for correctly orienting the container as it is installed so that the outlet tube 36 will be oriented with its entrance 40 up and in the vapor pocket 44. A can brace 55 holds the can 10 against the fixedly positioned rigid channel 58 so that the fixture 35 depresses the valve stem 34 against the internal biasing spring in the valve and holds the valve 30 open so that fuel vapor may flow through the valve into the channel 58 and into the burner 60. A gas flow adjustment valve 62 in the channel 58 controls the flow rate of the vapor and the resultant burner flame.

The thickness of the container side wall 12 and the material of which it is comprised are together selected so that if there is elevated pressure of at least 6 psig within the container, the side wall 12 remains resistant to easy deformation by normal finger pressure or easy crushing by normal hand pressure of a normal adult. However, when the can contents are exhausted below a pressure of 3 psig, the side wall is sufficiently flexible and weak that it can be easily distorted by the finger pressure exerted by a normal adult and it can easily be crushed by the crushing force exerted by one hand of a normal adult when the valve 30 is open, permitting exhaustion of remaining gas pressure from the interior of the container 10.

The heat of the cooking flame will heat the channel 58 and deliver some heat to the container 10 past the valve 30 and the lid 20 in addition to heat provided to the container by the ambient atmosphere. When the can contents are nearly exhausted, it is removed from the stove 50, the valve 30 is opened to permit exhaustion of remaining fuel and the can may be crushed by a user with the valve opened, so that remaining gas pressure is relieved as the can is crushed. It is beneficial that the can be crushed with the valve 30 opened so that most of the fuel vapor escapes and the small remaining residue is too small to provide an explosive mixture with ambient air.

FIG. 2 illustrates a technique for depressurizing a container 10. When the container 10 is removed from the stove 50, it is stood upright on its bottom 14 leaving a now small pool 42 of remaining fuel and a large still pressurized vapor pocket 44. A depressurizing fixture 64 is removably placed on the now re-exposed valve stem 34. When an operator pushes down on the depressurizing fixture 64 it presses on the valve stem to open the valve 30 allowing the remaining fuel vapor in the vapor pocket 44 to exhaust through the valve, depressurizing the can. The fixture 64 also serves as an overcap for the can. While continuing to hold the depressurizing fixture down and open the valve, the operator crushes the can side wall by squeezing it in the palm of his hand, making the can safe and indicating that it has been depressurized and therefore available for safe recycling.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A fuel supply container for a vaporizable liquid; flame producing fuel, the container comprising:

a side wall with opposite ends, a container bottom at one end of the side wall and a lid at the other end of the side wall; the container having an exposed exterior, exposed to heat produced by flame at a vapor tube;

a valve in the lid, a vapor entrance in the container leading through the valve, with the container orientable so that the vapor entrance is in a vapor pocket above a pool of liquid fuel under pressure in the container; a vapor tube which communicates to the valve, the vapor entrance is an inlet to the tube;

the side wall of the container is of such material and is sufficiently thin that when the container is pressurized at least to a level sufficient to supply fuel through the valve for production of a flame, the side wall is rigid against both deformation of the side wall by normal finger pressure of an adult and crushing of the side wall by normal hand pressure of an adult, and when the pressure in the can is at most slightly above atmospheric pressure, the can side wall may be deformed by normal finger pressure of an adult, and be crushed by normal hand pressure of an adult, with the valve open permitting exhaustion of vapor pressure in the can and the sidewall is also sufficiently thin that burning of the vaporized fuel at the tube outlet heats the container side wall and through the heating of the sidewall, heats the liquid fuel in the container to improve the flame.

2. The container of claim 1, wherein at least one of the bottom and the lid is attached or integrally formed with the side wall.

3. The container of claim 2, wherein the container is a drawn and ironed metal can.

4. The container of claim 3, wherein at least one of the container bottom and the lid is thicker than the side wall.

5. The container of claim 3, wherein the side wall of the container is steel and the side wall has a thickness of 0.002 to 0.006 inch.

6. The container of claim 3, wherein the side wall of the container is aluminum.

7. The container of claim 1, wherein the container, the bottom and the lid are all of one piece.

8. The container of claim 7, wherein the container is a drawn and ironed metal can.

9. The container of claim 1, wherein the side wall is cylindrical.

10. The container of claim 1, wherein the side wall of the container is steel.

11. The container of claim 10, wherein the side wall has a thickness of 0.002 to 0.006 inch.

12. The container of claim 1, wherein the side wall of the container is aluminum.

13. The container of claim 1, further comprising a valve stem on the valve projecting out of the lid and connected with the valve for operating the valve.

14. The container of claim 13, further comprising a fixture removably placeable on the valve stem for covering the stem and for being operable to operate the stem to operate the valve.

15. In combination, a cooking stove and a container according to claim 1, wherein the container has a supply of the liquid fuel therein, which is at a pressure sufficient to expel fuel vapor from the container, and the container is filled with fuel to a level such that a pocket of fuel vapor is formed above a pool of the liquid fuel in the container, and the vapor entrance is above the pool of liquid and in the vapor pocket;

a conduit from the valve; a burner connected with the conduit for being supplied by fuel vapor from the container and at which a flame may be generated.

16. The combination of claim 15, further comprising a container orienting collar on the container or on the valve and a fixture in the stove for cooperating with the collar to orient the container in the stove such that the vapor entrance will be in the vapor pocket and not in the pool of liquid.

17. The combination of claim 16, wherein the cooperating collar on the container and the fixture in the stove orient the container so that the vapor entrance to the vapor tube will be in the vapor pocket above the pool in the container.

* * * * *